United States Patent [19]

Unger et al.

[11] Patent Number: 5,003,904

[45] Date of Patent: Apr. 2, 1991

[54] KEEL ASSEMBLY

[76] Inventors: William Unger, 1006 - 420 Mill Road, Etobicoke, Ontario, Canada, M9C 1Z1; Lawrence A. Caza, 46655 Russell Road, Sardis, British Columbia, Canada, V2R 1B1

[21] Appl. No.: 344,240

[22] Filed: Apr. 26, 1989

[51] Int. Cl.[5] ..... A63C 15/06

[52] U.S. Cl. ..... 114/140; 114/143; 441/79

[58] Field of Search ..... 114/127, 140, 141, 142, 114/143, 162; 441/79

[56] References Cited

U.S. PATENT DOCUMENTS

| | | | |
|---|---|---|---|
| 3,080,845 | 3/1963 | Pollak | 114/140 |
| 4,307,677 | 12/1981 | Jastram et al. | 114/162 |
| 4,327,657 | 5/1982 | Knoos | 114/162 |
| 4,733,496 | 3/1988 | Wallner | 114/140 |

FOREIGN PATENT DOCUMENTS

| | | | |
|---|---|---|---|
| 3040104 | 8/1982 | Fed. Rep. of Germany | 114/140 |
| 2553734 | 4/1985 | France | 114/140 |
| 1400942 | 6/1988 | U.S.S.R. | 114/140 |

*Primary Examiner*—Sherman D. Basinger
*Assistant Examiner*—Stephen P. Avila
*Attorney, Agent, or Firm*—Thomas A. O'Rourke

[57] ABSTRACT

A keel assembly for a water craft. The keel assembly has a body having an aerodynamic cross section with a pair of side faces and a leading edge section. A portion of the leading edge section is movable relative to the body. A pair of vanes are spaced from and connected to the leading edge section to be disposed within a flow of water past the body. A pair of arms join the vanes with the portion. Movements of the vanes pivot the portion toward the direction of flow of the water to offset the effects of a negative pressure region occurring at the leading edge section.

8 Claims, 10 Drawing Sheets

KEEL ASSEMBLY

The present invention relates to hydrofoil devices used on water craft and more particularly to those for use on sailboards.

From its inception 20 years ago, boardsailing has grown into a world wide phenomenon practised by millions of people of all ages. The success of boardsailing as a sport has led to extensive development to improve the performance of the equipment to achieve, among other things, improved upwind ability and increased speed.

A current equipment related performance limitation of the sport is due to the skeg, or 'fin' at the back of the board. The purpose of the skeg is to keep the board going in a straight line as does a rudder on a sail boat and, more importantly, to give the board lateral resistance to the wind as does a keel on a sail boat. Since high performance sailboards have no keel or centre board, they must rely on the skeg to act as both rudder and keel. Herein lies the problem. As the sailboard reaches a certain water speed or angle of attack, the skeg loses all effectiveness in maintaining directional control and lateral resistance. This phenomenon is the result of either 'stall' or 'cavitation' of the skeg and in general is known to boardsailors as 'spin-out'. It remains as a significant limitation on the performance of sailboards.

The most pertinent prior art of which the applicant is aware is Canadian Patent 1,062,091 to Haddock and Canadian Patent 1,186,181 to Mistral Windsurfing Ag. Both of these references are directed at a technique to adjust the shape of a keel cross section. This is done by providing a pair of flexible side walls which extend the distance between the leading and trailing edges of the keel and are deflected in reaction to the prevailing flow conditions across the keel.

While discussion herein is restricted to a sailboard, it will be readily understood that these problems are also to be found in certain other water craft.

It is therefore an object of the present invention to provide a novel technique to improve the performance of water craft.

Briefly stated, the invention involves a keel assembly for a watercraft comprising:

a body having a pair of side faces and a leading edge extending the length of said body, said body having a leading portion and a trailing portion, at least a portion of said leading edge being located on said leading portion;

first connecting means connecting said leading portion with said trailing portion for movement relative thereto;

vane means to be disposed within a flow of water relative to said body, said flow having a direction of travel wherein said vane means extends rearwardly of said leading edge; and second connecting means joining said vane means with said leading portion, said second connecting means constituting means to transmit movements of said vane means to said leading portion to orient said leading portion towards said direction of travel to offset the effects of a negative pressure region occurring near said leading edge.

In another aspect of the present invention, there is provided a kit for improving the performance of a keel for a water craft, comprising:

leading edge means arranged for attachment to a leading edge of a keel;

connection means for attaching the leading edge means to the leading edge for movement relative thereto;

vane means for attachment to the leading edge means and to be disposed within a flow of water past the keel; the flow having a direction of travel;

coupling means to attach the vane means to the leading edge means so that the vane means follows the direction of flow; the coupling means constituting means to transmit movements of the vane means to the leading edge means to orient the leading edge means toward the direction of travel.

In yet another aspect of the present invention, there is provided a method of improving the performance of a keel for a water craft, comprising the steps of:

providing a leading edge means for attachment to a leading edge of a keel;

connecting the leading edge means to the leading edge for movement relative thereto;

providing a vane means which is attachable to the leading edge means so as to be disposed within a flow of water past the keel, the flow having a direction of travel;

coupling the vane means to the leading edge means so that the vane means follows the direction of flow and so that movements of the vane means are transmitted to the leading edge means to orient the leading edge means toward the direction of travel.

The term 'keel' used herein is used as a generic term to cover both the keel of a sail boat and a skeg of a sailboard as well as any stabilizing member used in a similar manner below the hull of other water craft.

Preferred embodiments of the present invention are illustrated in the appended drawings in which.

Figure 1:
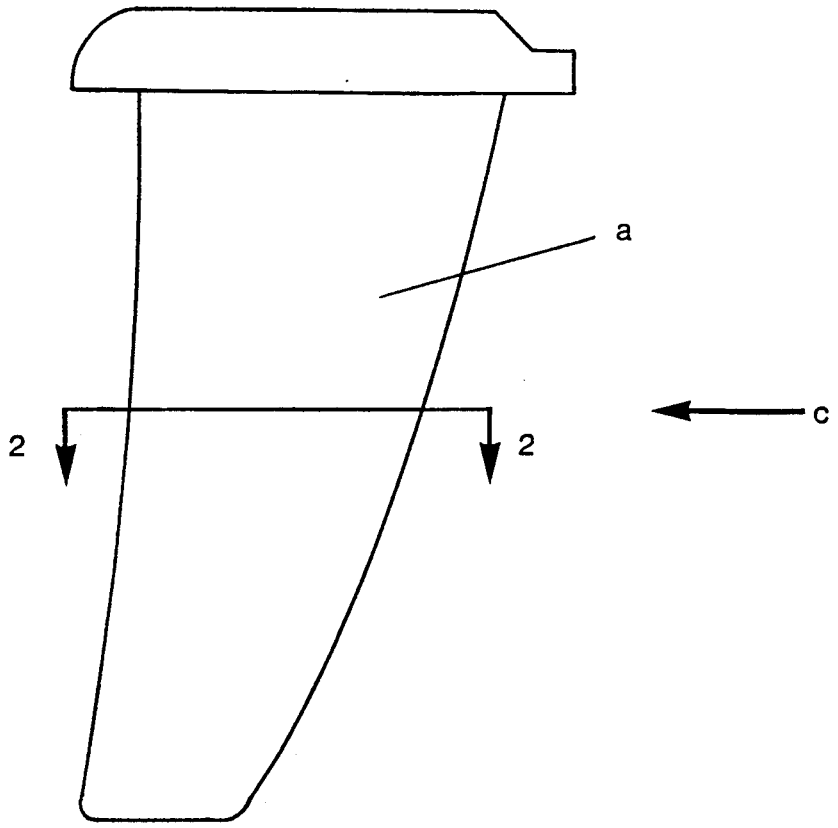
Figure 1 Prior Art
FIG. 1 is a side view of a conventional skeg.
Figure 2:
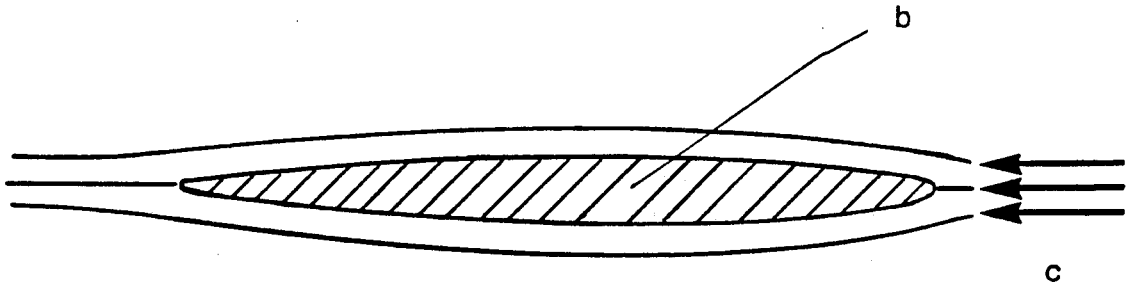
Figure 2 Prior Art
FIG. 2 is a schematic sectional view taken on line 2—2 of FIG. 1.
Figure 3:
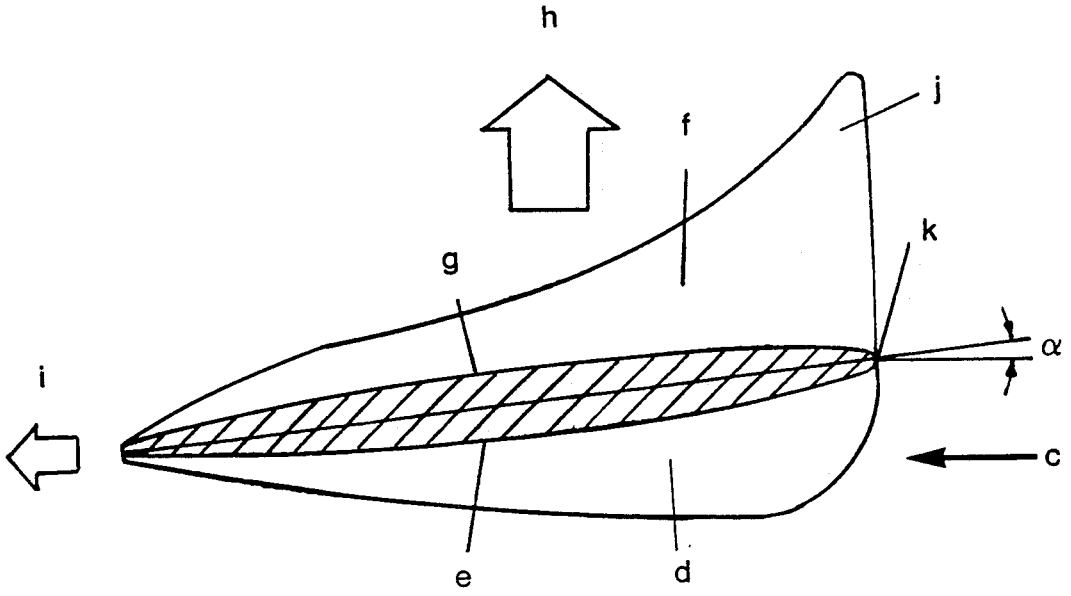
FIG. 3 is a schematic cross sectional representation of a conventional skeg illustrated in FIG. 1.

Before discussing the preferred embodiments, it would be appropriate to discuss the onset of stall or cavitation as it occurs on conventional sailboard skegs. The cross section of a conventional sailboard skeg is shown at 'b' in FIG. 2 in a 'flow' of water. The term 'flow' here refers to the relative movement of the water relative to the sailboard. The direction of flow is shown by the arrows 'c'. When the skeg is aligned with the direction of flow, the water will pass the skeg on either side thereof. The skeg is rotated relative to the direction of flow (as shown in FIG. 3), to allow the skeg to generate 'lift' and thereby provide a counter force to the sailboard against the lateral force generated by the wind on the sail. In this orientation, water passes by the skeg in a manner causing a high pressure region 'd' on the side face 'e' of the board facing the oncoming water and a region of relatively lower pressure 'f' on the opposite side face 'g' of the skeg. By virtue of the pressures thus formed, the skeg generates lift 'h' and drag 'i'. This angle, alpha, at which the skeg is oriented with respect to the oncoming flow is known as the 'angle of attack'.

The 'lift' is a transverse force which counters the transverse component of the wind force on the sail. If the 'lift' is reduced to the point where it no longer balances the transverse component of the wind force, the sailboard will tend to follow the direction of the wind, which means that the boardsailor's ability to control the direction of the sailboard, particularly when heading into the wind, is substantially reduced.

Within this low pressure region 'f' is a region of minimum pressure 'j' located immediately behind the skeg's leading edge illustrated at 'k'. This region of minimum pressure can induce two phenomena which limit the performance of the skeg and, in turn, the sailboard. At relatively low speeds and high angles of attack, the region of minimum pressure results in an adverse pressure gradient across the chord of the skeg. This can cause the flow to separate from the side face 'g' resulting in the loss of lift. This phenomenon is known as 'stall'.

At relatively high speeds, this region of minimum pressure may be sufficiently extreme to cause the water flow to vaporize. This effect is known as 'cavitation' and results in a drastic increase in drag with an associated decrease in lift.

Since the 'lift' is suddenly reduced, the transverse component of the wind force on the sail suddenly overwhelms the opposing force of the keel and the sailboard shifts sideways in the direction of the wind. This causes the boardsailor to lose control in a condition called 'spin-out'.

Figure 4:
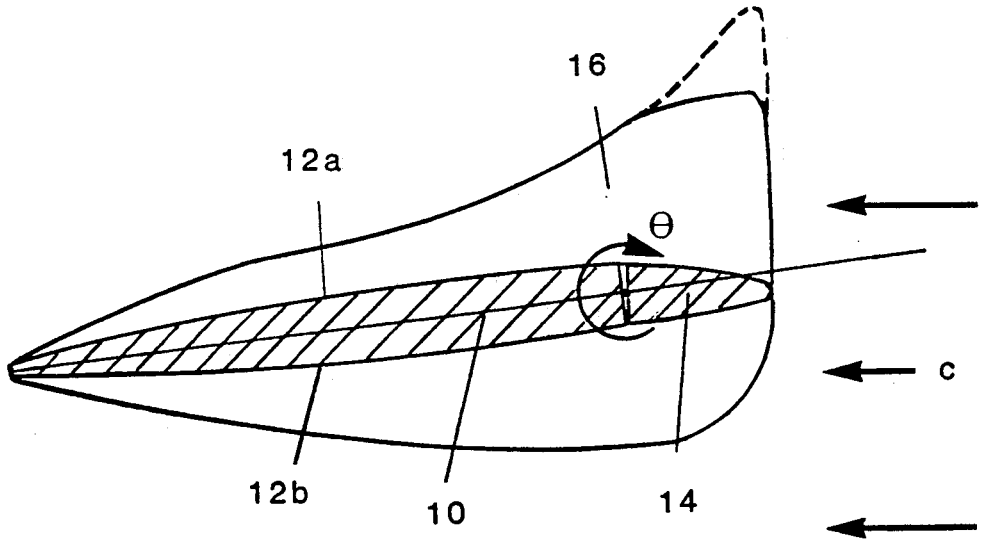
FIG. 4 is schematic cross sectional representation of a skeg according to the present invention.
Figure 5:
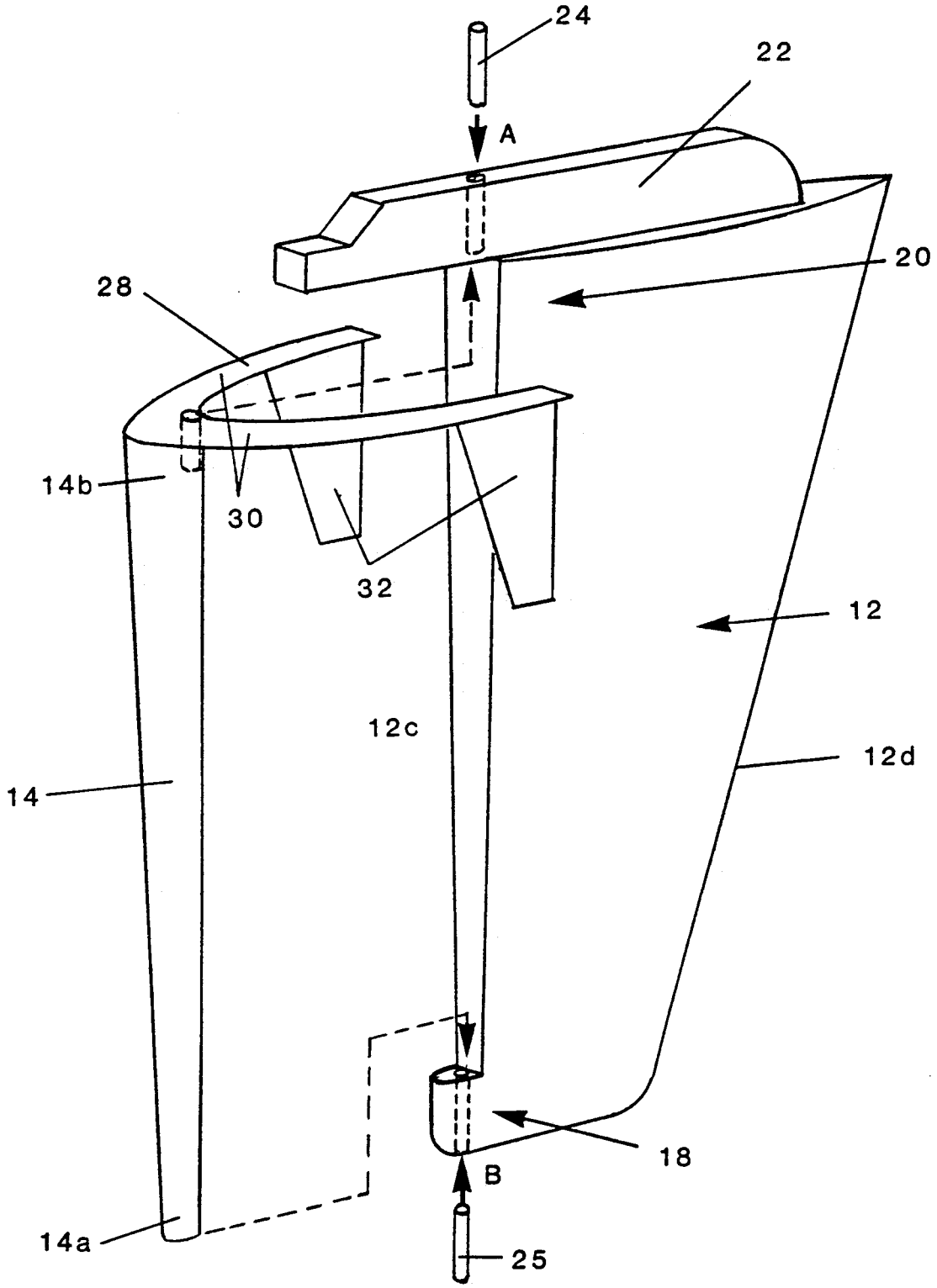
FIG. 5 is an exploded fragmentary perspective view of the skeg assembly illustrated in FIG. 4.
Figure 6:
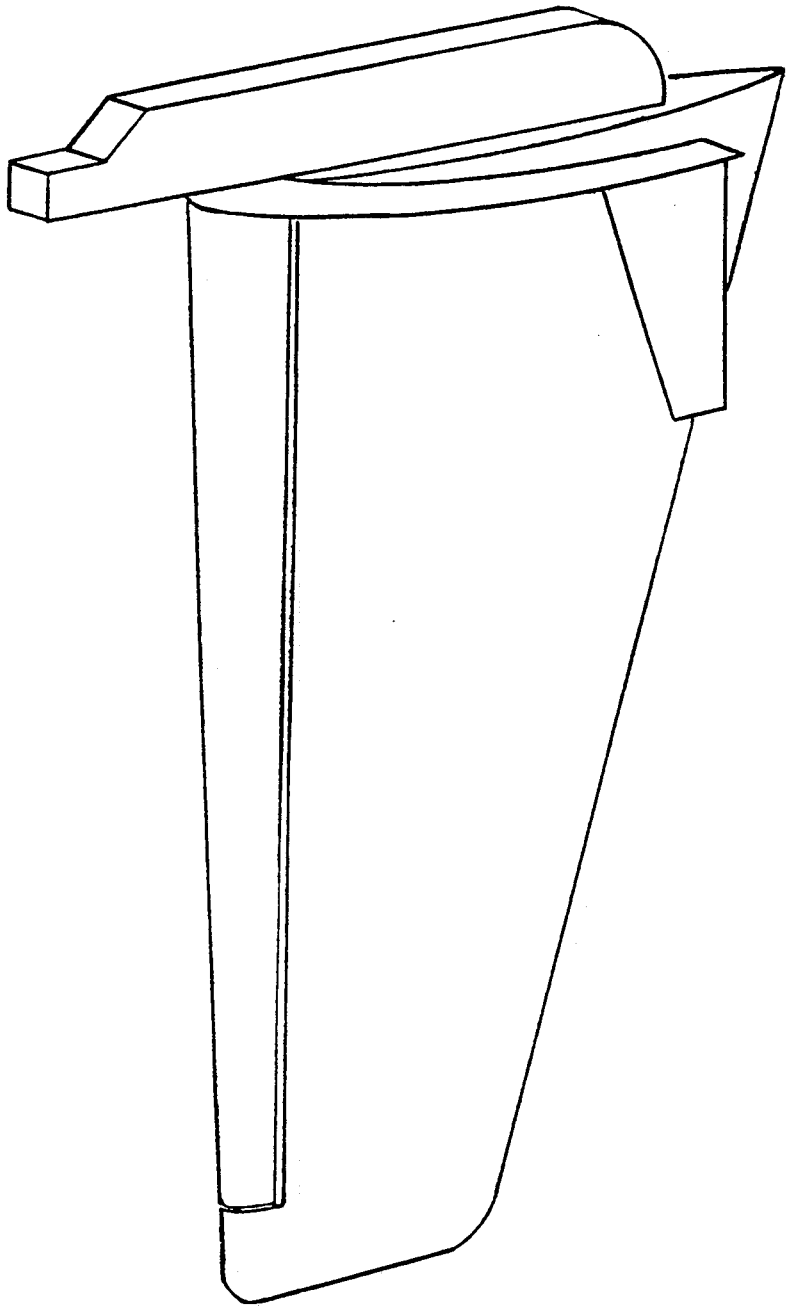
FIG. 6 is a perspective view of the skeg assembly illustrated in FIG. 4.
Figure 7:
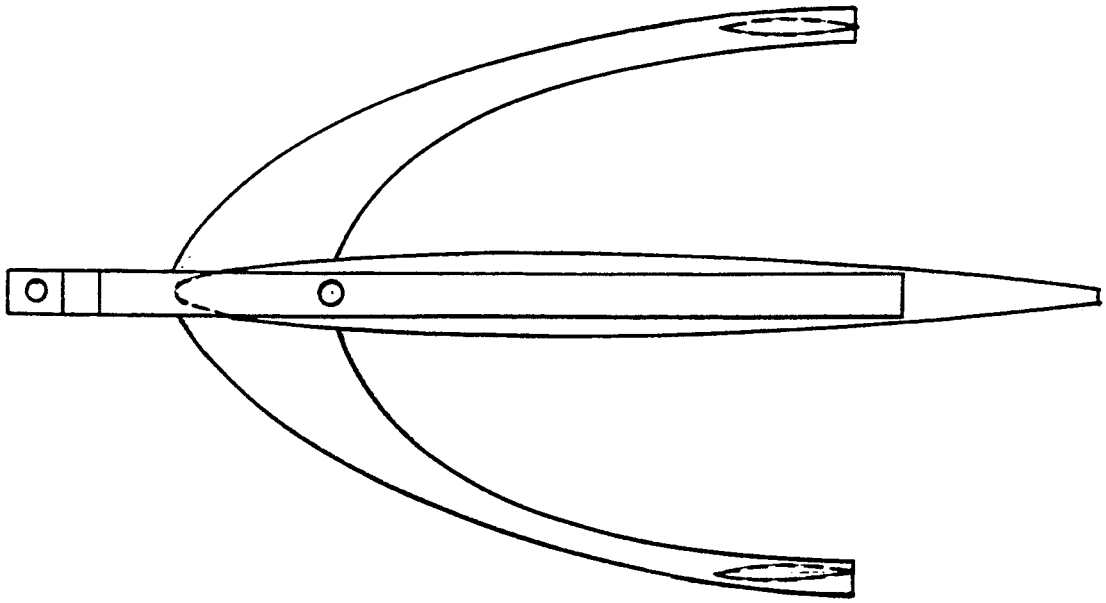
FIG. 7 is a plan view of the skeg assembly illustrated in FIG. 4.
Figure 8:
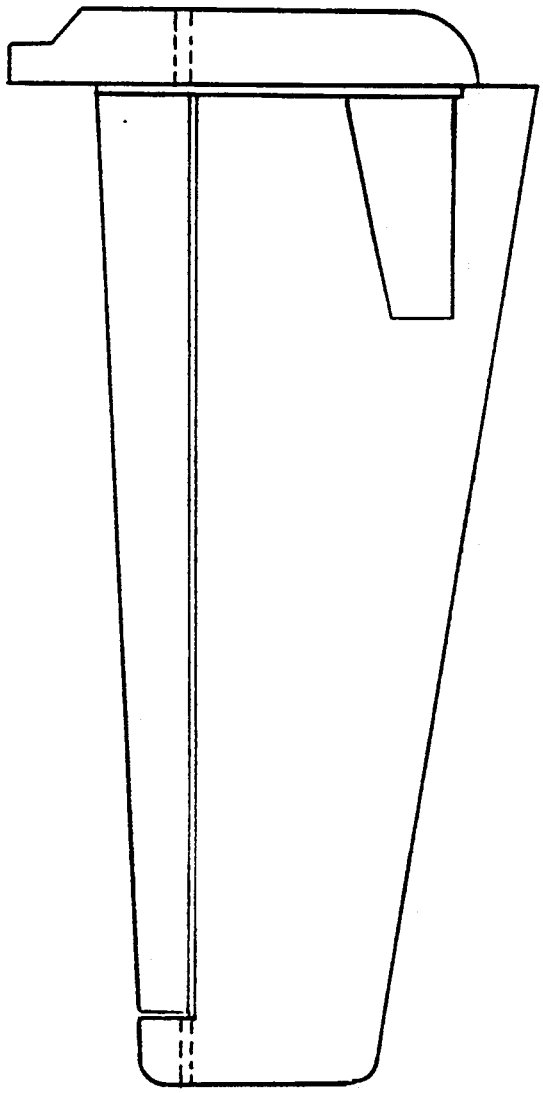
FIG. 8 is a side view of the skeg assembly illustrated in FIG. 4.
Figure 9:
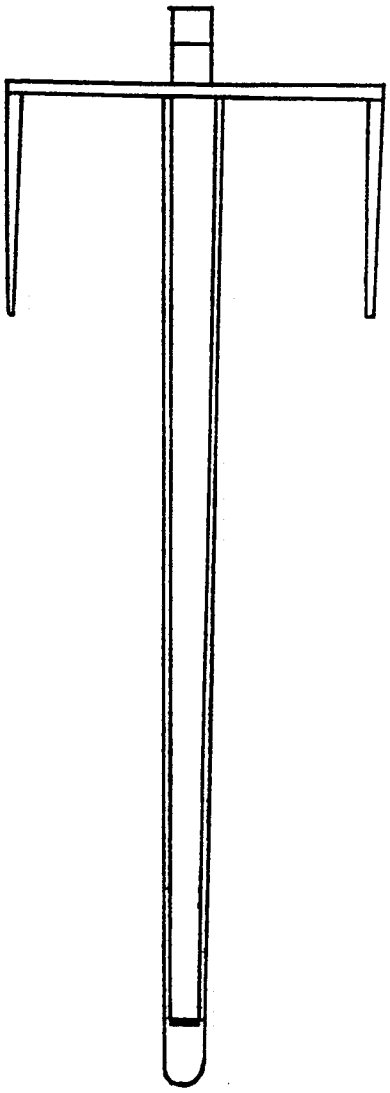
FIG. 9 is a front view of the skeg assembly illustrated in FIG. 4.

In contrast to the prior art, a skeg according to the present invention is schematically illustrated at 10 in FIG. 4 having a body of aerodynamic cross section with side faces 12*a* and 12*b*. The body has a trailing portion 13 and a leading portion 14 in the form of a leading edge section 14 pivotally attached thereto. As schematically represented by the rotation 'theta' in FIG. 4, a mechanism is provided whereby the leading edge section 14 is turned toward the direction of flow 'c' so that the region of minimum low pressure is substantially reduced, thereby reducing the likelihood of the onset of both stall and cavitation. This is shown in FIG. 4 wherein the region of minimum pressure (shown in dashed lines) is replaced by a continuation of the region of relatively less extreme low pressure 16 extending along substantially the entire length of the surface 12*a*.

The skeg assembly 10 is shown in more detail in FIGS. 5 to 9. The body 12 has a lower region 18 and an upper region 20, the latter of which is coupled with a mounting bracket 22 of suitable construction. The body 12 also has a front face 12*c* and a rear face 12*d* which converge toward the lower region 18. The leading edge section 14 is pivoted at the front face 12*c* to the upper region 20 by a first connecting means in the form of a pivot pin 24 which fits into a matching hole in the manner illustrated by the arrow 'A'. The leading edge section 14 tapers toward its lower end 14*a* and is held to the lower region 18 by another first connecting means in the form of pivot pin 25 which fits into a matching hole. The above mentioned mechanism to turn the leading edge section 14 toward the flow direction is embodied in a trailing vane section 28 which is attached to the upper end 14*b* of the leading edge section 14.

Second connecting means are provided to join the trailing vane section 28 with the leading edge section and are in the form of arms 30 which extend laterally outwardly from side faces 12*a*, 12*b* and rearwardly of the leading edge section 14. An aerofoil 32 having an aerodynamic cross section and a wing-like planform depends from each arm 30. In conjunction with the arms 30, each of these aerofoils 32 constitute a vane which acts to turn the pivoted leading edge section 14 toward the direction of flow of oncoming water.

The body 12, the leading edge section 14 and the trailing vane section 28 may be formed of metal, plastic or composite materials or any other suitable material as desired.

To assemble the skeg assembly 10, the leading edge section 14 with the attached trailing vane section 28 is mounted on the body 12 by inserting the pivot pins 24 and 25 in the holes as shown by arrow A and B respectively. It will thus be seen that the skeg assembly 10 is simple to assemble.

With the appropriate mounting hardware, the skeg may then be mounted on the sailboard.

Figure 10:
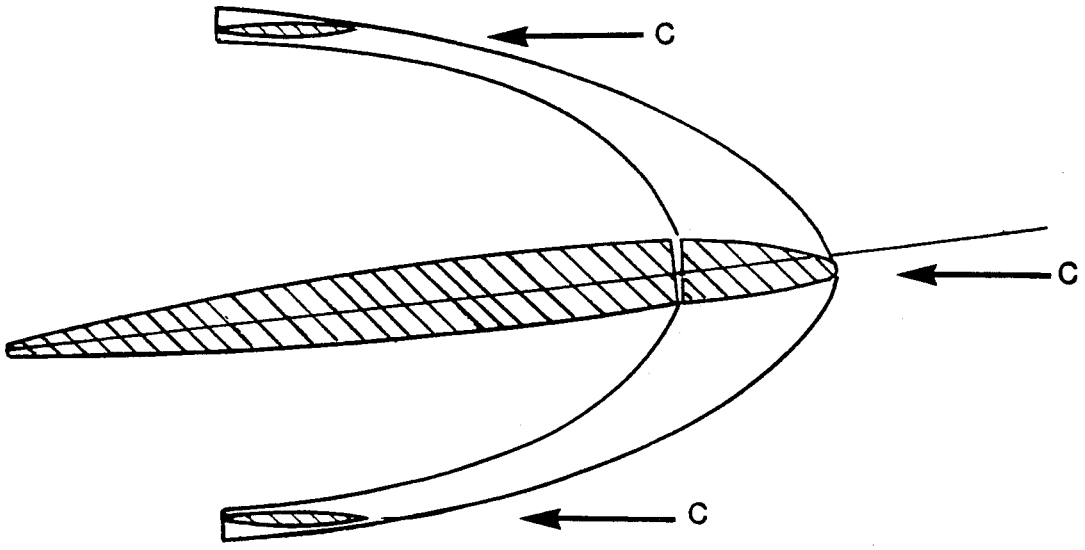
FIG. 10 is a schematic cross sectional representation of the skeg assembly illustrated in FIG. 4.

During use, the skeg assembly 10 functions in the same manner as a conventional skeg only when its central axis is in line with the direction of flow of the water. However, when the angle of attack, alpha, is increased as shown in FIG. 10, the trailing vane section 28 is maintained in alignment with the direction of flow as it is free to pivot about the pivot pins 24 and 25. This causes the leading edge section 14 to remain oriented toward the flow direction thereby to counter the onset of those phenomena leading to stall or cavitation as would occur in similar circumstances with the a skeg of conventional construction.

Figure 11:
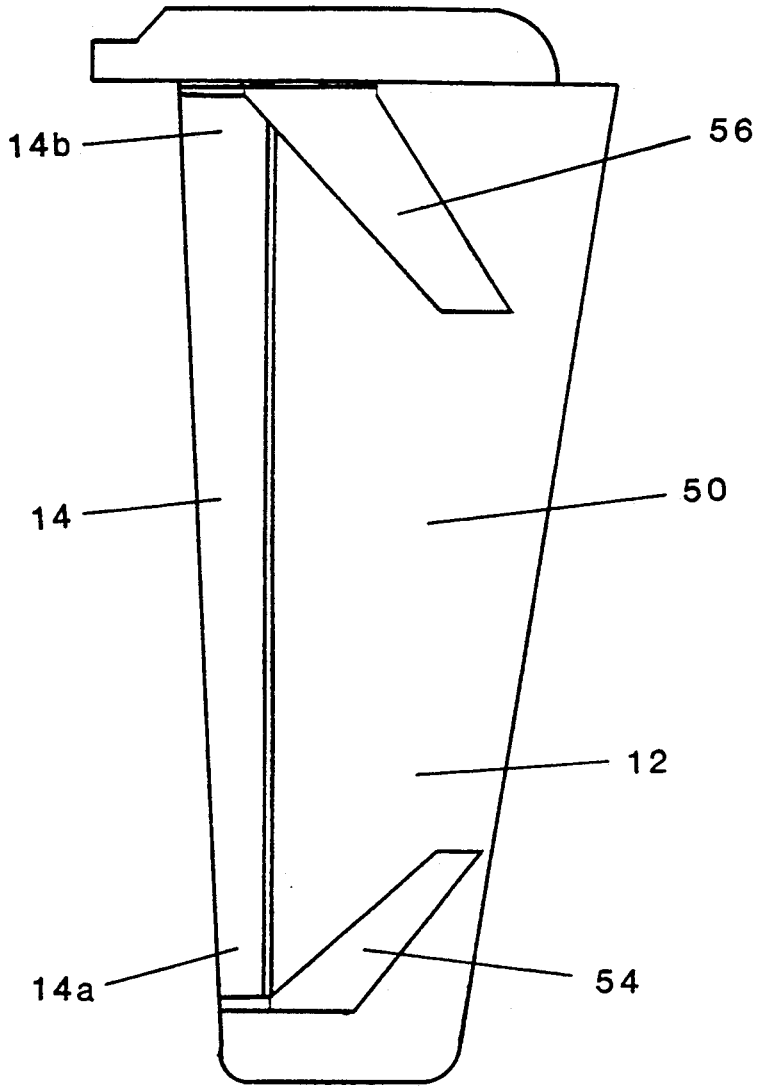
FIG. 11 is a side view an alternative skeg assembly.
Figure 12:
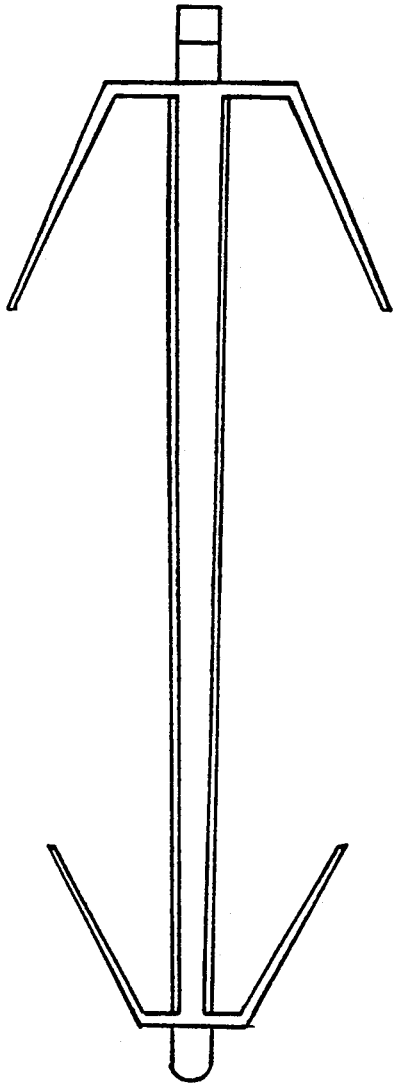
FIG. 12 is a front view of the skeg assembly illustrated in FIG. 11.

FIGS. 11 to 12 illustrate an alternative skeg assembly 50. In this figure, elements equivalent in function with those in the previous embodiment are identified with like numerals. A significant feature of the assembly 50 is the use of a pair of lower trailing vanes 54 which are attached to the lower end 14*a* and which extend laterally outwardly from a respective side face of the body 12 and are angled upward and rearward of the leading edge section 14. Similarly, a pair of upper trailing vanes 56 are attached to the upper end 14*b* and extend laterally outwardly from a respective side face but in a downward and rearward direction from the leading edge section 14.

The skeg assembly operates in identical fashion to the previous skeg assembly. However, the elimination of the arms 30 simplifies manufacture while the addition of the additional pair of trailing vanes improves performance in rough water where the uppermost vanes may momentarily leave the water and be rendered ineffective in orienting leading edge toward the flow direction.

Thus, the present invention provides a skeg which is able to adjust automatically its 'camber', that is the curvature of the median line of the profile of the keel, to that best suited for the angle of attack of the keel relative to the flow direction. It is able to do this since it has a separate leading edge section hinged to the skeg body. By employing a trailing vane attached to the leading edge which causes the leading edge section to be turned toward the flow direction, the skeg takes on a different cambered configuration and this in turn counters the physical processes herein above described causing stall and cavitation. This allows the skeg to achieve a greater angle of attack and thereby generate more 'lift' prior to stalling as well as to achieve a higher speed prior to cavitation. By virtue of this enhancement, the performance limitation imposed on conventional skegs is eliminated.

While the embodiments discussed hereinabove have been directed at sailboards, it will become readily seen that the present invention is equally applicable to other sail craft.

In addition, the leading edge section, the vanes and the associated coupling hardware to couple them to the body of the keel can conveniently form a kit to improve existing keels. In this case, the leading edge section would be designed to compliment the shape of the body of the keel. The coupling hardware should have a relatively low profile to minimize the interruption of the flow of water past the keel.

If desired, the function of the vane and the leading section may be performed by a single leading edge component. In this instance, the leading edge component would be attached to the leading edge of a keel assembly so that it can move to follow the direction of travel of the flow of water past the keel. This movement will in turn counter the peak negative pressure appearing at the leading edge of the keel.

It will also be understood that the vanes may not necessarily trail the leading edge as described hereinabove but may be disposed in front of the leading edge, provided a suitable mechanism joins the vane with the leading edge section so that the latter will be turned toward the flow direction. The ability of the vane means to follow the direction will depend to a great extent on the range of rotation given to the leading edge section by the connecting mechanism joining it to the body of the keel. If the range is relatively small, the ability of the vane means to follow the flow will be correspondingly reduced. In addition, the connecting mechanism should be selected so that the friction therein is relatively low to permit the force of the water against the vanes to dictate their orientation.

In addition, the leading edge need not extend the entire length of the body of the skeg. Instead, a leading edge section with a length which is merely a fraction of the length of the body may only be necessary to counter the onset of stall or cavitation in some instances.

We claim:

1. A keel assembly for a watercraft comprising:

a body having a pair of side faces and a leading edge extending the length of said body, said body having a leading portion and a trailing portion, at least a portion of said leading edge being located on said leading portion;

first connecting means connecting said leading portion with said trailing portion for movement relative thereto;

vane means to be disposed within a flow of water relative to said body, said flow having a direction of travel wherein said vane means extends rearwardly of said leading edge; and second connecting means joining said vane means with said leading portion, said second connecting means constituting means to transmit movements of said vane means to said leading portion to orient said leading portion towards said direction of travel to offset the effects of a negative pressure region occurring near said leading edge.

2. A keel assembly as defined in claim 1 wherein said leading portion defines substantially the entire length of said leading edge.

3. A keel assembly as defined in claim 2 wherein said leading portion is separate from said trailing portion, said first connecting means including pivot means joining said leading portion with said trailing portion.

4. A keel assembly as defined in claim 1 wherein said vane means includes a pair of trailing vanes, one adjacent each side face of said body, said second connecting means including a pair of arm portions each of which is fixed at one end to and extends laterally outwardly from said leading portion and is fixed at an opposite end to one of said vanes.

5. A keel assembly as defined in claim 2 wherein said vane means includes a pair of upper trailing vanes, one disposed adjacent each side face of said body and attached to an upper end of said leading portion, each of said upper trailing vanes extending laterally outwardly relative to an associated side face and downwardly and rearwardly relative to said upper end.

6. A keel assembly as defined in claim 5 wherein said vane means further comprises a pair of lower trailing vanes, one disposed adjacent each side face of said body and attached to a lower end of said leading portion, each of said lower trailing vanes extending laterally outwardly relative to an associated side face and upwardly and rearwardly relative to said lower end.

7. A kit for improving the performance of a keel for a water craft, comprising:

leading edge means arranged for attachment to a leading edge of a keel;

connecting means for attaching said leading edge means to said leading edge for movement relative thereto;

vane means for attachment to said leading edge means and to be disposed within a flow of water past said keel; said flow having a direction of travel;

coupling means to attach said vane means to said leading edge means so that said vane means follows said direction of flow; said coupling means constituting means to transmit movements of said vane means to said leading edge means to orient said leading edge means toward said direction of travel.

8. A method of improving the performance of a keel for a water craft, comprising the steps of:

providing a leading edge means for attachment to a leading edge of a keel;

connecting said leading edge means to said leading edge for movement relative thereto;

providing a vane means which is attachable to said leading edge means so as to be disposed within a flow of water past said keel, said flow having a direction of travel;

coupling said vane means to said leading edge means so that said vane means follows said direction of flow and so that movements of said vane means are transmitted to said leading edge means to orient said leading edge means toward said direction of travel.

* * * * *